United States Patent [19]

Baba et al.

[11] 4,005,243

[45] Jan. 25, 1977

[54] FREELY MACHINABLE ALUMINUM ALLOY

[75] Inventors: Yoshio Baba; Akira Takashima, both of Nagoya, Japan

[73] Assignee: Sumitomo Light Metal Industries, Ltd., Tokyo, Japan

[22] Filed: July 18, 1975

[21] Appl. No.: 597,374

[30] Foreign Application Priority Data

Dec. 2, 1974 Germany ..... 2456866

[52] U.S. Cl. ..... 428/469; 75/140; 148/31.5; 148/32.5; 204/38 A; 204/38 E; 204/58

[51] Int. Cl.[2] ..... B32B 15/04

[58] Field of Search ..... 75/140, 147; 204/38 A, 204/38 E, 58; 148/32, 32.5, 31.5; 428/469

[56] References Cited

UNITED STATES PATENTS 3,161,502 12/1964 Hunsicker et al. ..... 75/140

*Primary Examiner*—R. Dean

*Attorney, Agent, or Firm*—Browdy and Neimark

[57] ABSTRACT

An aluminum alloy with freely-machinable or free-cutting properties and corrosion resistance consists essentially of aluminum, copper, magnesium, tin, lead, and silicon and optionally further contains small amounts of any one or more of the elements selected from chromium, manganese, titanium, vanadium and zirconium. This alloy has the property for preventing peeling-off of an anodically oxidized surface layer after being heated at an elevated temperature.

8 Claims, 6 Drawing Figures

A

B

C $A^+$

A

FREELY MACHINABLE ALUMINUM ALLOY

FIELD OF THE INVENTION

The present invention relates to an aluminum alloy superior in free-machinability, i.e., free-cutting properties, the alloy being improved in corrosion resistance and being particularly free from peeling-off of surface layers on products made of the alloy which are treated with "anodic oxidization", successively coated with paint and then cured at a high temperature.

BACKGROUND OF THE INVENTION

As for conventional aluminum alloys of good free-machinability there are known alloys such as AA 2011 and AA 6262. Alloy AA 2011 contains copper essentially and small amounts of a few elements of heavy metals. Alloy AA 6262 contains magnesium and silicon essentially and in addition, small amounts of a few elements of heavy metals. The former, however, is rather poor in corrosion resistance, while the latter, in spite of its considerably high corrosion resistance, has not always shown satisfactory performance in so far as its ability to be free cut is concerned.

Furthermore, various kinds of aluminum alloy products coated with paint are widely used. A typical manufacturing process of such products is as follows: After being worked to a final configuration from a bar or tubing of aluminum alloy, the product is subjected to anodic oxidation, followed by a coating process with acrylic resin paint and the paint is then baked or cured to provide weather-proof coating. During such curing operation, the product is generally heated to a rather high temperature of about 160° C. and it has been widely recognized that the oxidized surface on products of such conventional aluminum alloys is apt to peel off from the substrate.

Accordingly, it has long been desired to provide an aluminum alloy which has excellent free-machinability and corrosion resistance and is further free from peeling off of anodically oxidized surfaces after being heat-treated at an elevated temperature enough to cure acrylic paint.

SUMMARY OF THE INVENTION

It is an object of the present invention to overcome the defects of the prior art, such as indicated above.

It is a principal object of the present invention to provide an improved aluminum base alloy having excellent free-cutting properties and good resistance against corrosion.

It is another object of the present invention to provide for improved aluminum alloy products.

It is another object of the present invention to provide an aluminum base alloy which has excellent free-cutting properties, good resistance against corrosion and an excellent resistance from peeling-off of skin surfaces treated with anodic oxidation after being heated at an elevated temperature, such as curing temperature of acrylic resin paint.

For a better understanding of the invention, possible embodiments thereof will now be described with reference to the attached drawing, it being understood that these embodiments are exemplary and not limitative.

DETAILED DESCRIPTION

It has been found through study that those metal elements having a low melting point such as Pb, Sn, Bi or Cd, when added to the alloy to improve free-cutting properties, have adversely affected conventional aluminum alloys at least with respect to peeling-off of the oxidized surface therefrom. Many attempts to find an effective method to overcome these aforesaid disadvantages, without sacrificing the free-cutting properties and corrosion resistance, were rewarded by obtaining a surprisingly effective aluminum alloy as will be pointed out below.

An aluminum base alloy of the present invention consists essentially of from 0.6 to 1.2 percent magnesium, from 0.5 to 0.8 percent silicon, sum of tin and lead ranging from 1.2 to 2.4 percent under the condition of tin content exceeding lead content, from 0.1 to 0.4 percent copper, there being added optionally thereto any one or more than one element of from 0.05 to 0.3 percent of chromium, from 0.1 to 0.5 percent manganese, from 0.05 to 0.3 percent zirconium, from 0.02 to 0.2 percent titanium and from 0.05 to 0.3 percent vanadium, balance aluminum and inevitable impurities, the percentages being expressed in weight percentage.

Magnesium in aforesaid compositional range of from 0.6 to 1.2 percent cooperates with tin and lead both in foregoing ranges to form Mg—Sn and Mg—Sn—Pb, while lead may form an eutectic structure with tin and thus surprisingly improves the free-cutting property. The percentages given are important in obtaining the desired properties in the alloy.

Figure 1:
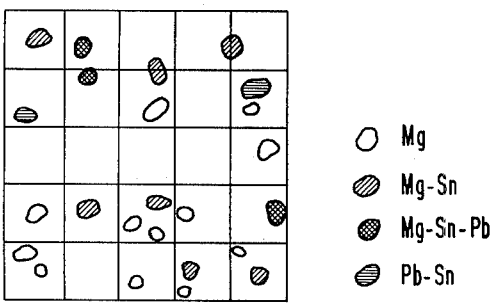
FIG. 1 is a graphical representation of Mg coexisting with Pb and Sn verified through an X-ray microanalyzer.

FIG. 1 certifies through an X-ray microanalyzer that Mg coexists with Pb or Sn, and also Pb coexists with Sn. In a conventional alloy, AA 6262, it has been found that $Mg_2Si$ may harden the alloy and, Pb and Bi may improve the free-cutting property. The reason has generally been explained in such a manner that the eutectic temperature of Pb and Bi being as low as 125° C., the eutectic structure of Pb and Bi may be melted quickly by the friction heat between the matrix alloy and a cutting tool. According to the present invention, the elements of Sn and Pb directly or by themselves improve the free-cutting property, while the eutectic temperature of Sn and Pb is 193° C. Therefore, so far as melting capability is concerned, the eutectic structure of Pb and Bi is greater than that of Sn and Pb, and the former seems to surpass the latter in the free-cutting property, too. The alloy of the present invention, however, has very excellent free-cutting property as described below.

The reason of this advantage is considered to be that, besides the eutectic structures, suitable amounts of Mg—Sn and Mg—Sn—Pb are generated as the compounds of Mg, as clarified in FIG. 1, and they may act effectively upon the free-cutting property. When magnesium is less than 0.6%, Pb is less than 0.4% or Sn is less than 0.8%, the foregoing advantage in free-cutting property, particularly in refining characteristics of chips, will be reduced to some extent. When the added amounts of magnesium, lead and tin exceed the specified ranges, i.e., 1.2% to 0.8%, 1.6%, respectively, the free-cutting property can not be improved so much as the deformation resistance may somewhat increase.

In case Pb exceeds 0.8% or Sn exceeds 1.6%, the preventive property from peeling-off of oxidized coating will tend to decrease. Furthermore, when the total amount of Sn and Pb is smaller than 1.2%, free-cutting property can not be improved and in case of more than 2.4%, the hot workability will be reduced. Still more, when the added amount of Sn is smaller than that of Pb, the free-cutting property can not be improved.

The significance of copper content within the specified range is to be understood as follows. Products of this kind of aluminum alloy may be punched after cutting operations, if required, resulting in yield cracks at sharp edges. Such shortcomings will be overcome by adding some copper to the alloy. The addition of copper will, as a further effect, improve the surface-treatability and mechanical properties. When the copper content is less than 0.1%, the aforesaid advantages will be reduced and in case of more than 0.4% the corrosion resistance will deteriorate.

Addition of silicon from 0.5 to 0.8 percent to the alloy surprisingly improves the strength of the substrate, because Si will be a hardening element coupled with the surplus Mg which has not been consumed as intermetallic compounds of Mg—Sn or Mg—Sn—Pb. The strengthening effect will be decreased when the Si content is less than 0.5%, while disadvantageous effects in corrosion resistance and workability will be accelerated in case of more than 0.8% Si.

The addition of from 0.05 to 0.3% chromium to the alloy prevents stress-corrosion cracking and peeling-off of oxidized surface. The corrosion resisting advantage will be reduced when the chromium content is less than 0.05%, and some intermetallic compounds will damage cutting tools in case of the use of more than 0.3% chromium.

Beside the foregoing elements, any one or more than one of the elements Mn, Ti, Zr, V and Be can be optionally added to the alloy. In case of being exposed to a corrosive atmosphere for long time under tensile stress equivalent to at least 75% of yield strength, additions of Mn up to 0.5% will improve the preventive property of stress-corrosion cracking and peeling-off of oxidized surface. When its content exceeds 0.5%, crystallized giant compounds will accelerate cutting tool abrasion.

Addition of Ti up to 0.2% refines crystal grains and prevents ingot cracking due to thermal stress generated during solidification particularly for ingots with comparatively large section, as well as improves the preventive property of peeling-off of the skin partially from anodically oxidized products. When its content exceeds 0.2% cutting tools will be damaged by hard intermetallic giant compounds of $TiAl_3$ generated within the substrate. Addition of V up to 0.3% improves, identically in case of Cr, the preventive property of stress-corrosion cracking and of peeling-off of the oxidized surface. In case of more than 0.3% V, cutting tools will be damaged by intermetallic compounds.

Addition of Zr up to 0.3% improves not only the preventive property from stress-corrosion cracking but also longitudinal mechanical properties. Intermetallic compounds will damage cutting tools in case of more than 0.3% Zr. Addition of Be up to 0.03% influences the alloy to prevent oxidation of Mg without failing in mechanical properties of the free-cutting alloy.

The present invention will be more readily understandable from a consideration of the following examples.

To begin with, the chemical compositions of the alloys of the subject invention, comparative alloys and conventional alloys which were used in the various kinds of tests on the free-cutting property, corrosion resistance, castability, hot workability and surface treatability, etc., are set forth in Table I.

Table I

| | | Chemical compositions of tested alloys | | | | | | | | | | | | | | |
|---|---|---|---|---|---|---|---|---|---|---|---|---|---|---|---|---|
| | | Chemical Composition (weight percents) | | | | | | | | | | | | | | |
| | Symbol | Mg | Sn | Sb | Pb | Bi | Cd | Si | Mn | Ti | Cr | Cu | Zn | V | Zr | Be |
| Conventional Alloys | X | 1.0 | | | 0.6 | 0.4 | | 0.6 | | | 0.1 | 0.3 | | | | |
| | Y | 1.0 | 0.4 | 0.2 | 0.6 | 0.4 | 0.2 | 0.6 | 0.8 | 0.1 | 0.1 | | | | | |
| Alloys of the Invention | A1 | 0.85 | 1.30 | | 0.65 | | | 0.65 | | | | 0.25 | | | | |
| | A2 | 0.84 | 1.35 | | 0.63 | | | 0.63 | 0.20 | | | 0.25 | | | | 0.01 |
| | A3 | 0.85 | 1.32 | | 0.65 | | | 0.64 | 0.25 | | | 0.25 | 0.30 | | | |
| | A4 | 0.87 | 1.31 | | 0.64 | | | 0.64 | 0.40 | | 0.25 | 0.24 | | | | |
| | A5 | 0.84 | 1.35 | | 0.65 | | | 0.65 | 0.25 | | | 0.25 | | 0.17 | | |
| | A6 | 0.84 | 1.37 | | 0.63 | | | 0.63 | 0.24 | | | 0.24 | | | 0.18 | |
| | A7 | 0.85 | 1.37 | | 0.62 | | | 0.64 | 0.26 | | | 0.23 | 0.27 | | 0.17 | |
| | A8 | 0.83 | 1.38 | | 0.63 | | | 0.63 | | 0.09 | | 0.25 | | | 0.18 | 0.005 |
| | A9 | 0.88 | 1.34 | | 0.62 | | | 0.64 | | 0.07 | 0.22 | 0.24 | | | | 0.003 |
| Comparative Alloys | K1 | 0.84 | 1.35 | | 0.63 | | | 0.64 | | | | 0.24 | | | | 0.004 |
| | K2 | 0.85 | 1.30 | | 0.64 | | | 0.65 | | | 0.39 | 0.22 | 0.63 | | | |
| | K3 | 0.85 | 1.32 | | 0.65 | | | 0.64 | | | 0.55 | 0.21 | | | | |
| | K4 | 0.84 | 1.33 | | 0.64 | | | 0.64 | | | | 0.25 | | 0.35 | | |
| | K5 | 0.83 | 1.30 | | 0.63 | | | 0.65 | | | | 0.24 | | | 0.33 | |

The producing methods of the test materials used in aforesaid tests under specified test conditions are briefly described below:

On each tested alloy, an ingot of 203 mm in diameter was produced by semi-continuous casting, cut at a length of 660 mm, and heat treated for homogenizing at 500° C. for 12 hours prior to an extruding process. Then the material was extruded at a temperature of from 390° C. to 450° C., followed by solution heat-treatment at 530° C. for 1 hour to be quenched immediately into water at 20° C. Subsequently, the material was artificially age-hardened at 175° C. for 8 hours and a rod of 10 mm in diameter in the T6 state was obtained.

Figure 2A:
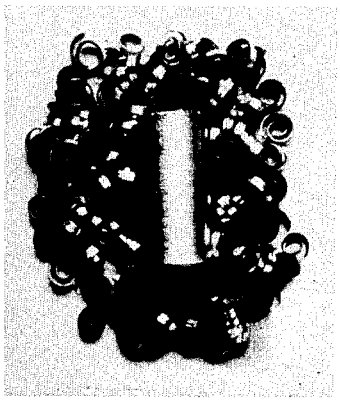
FIGS. 2A, 2B and 2C show classified representations of various configurations of chips.
Figure 2B:
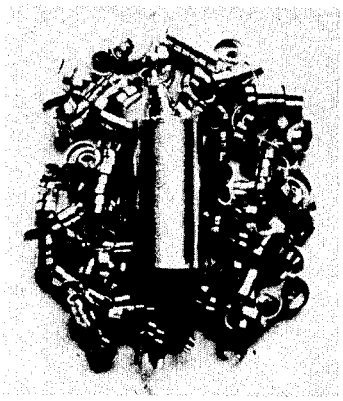
Figure 2C:
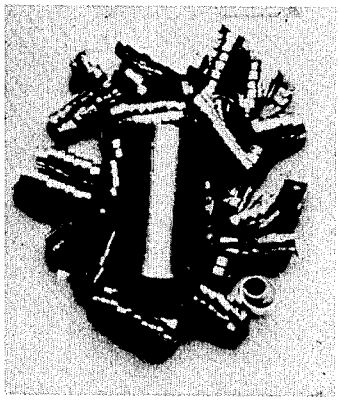

The mechanical tests were carried out with test pieces of No. 9 type specified in JIS (Japanese IndustriaL Standards) having a gauge length of 100 mm. For judging the free-cutting property, comparison was run on shapes of chips obtained under the same cutting conditions, i.e., a back rake angle of 5°, circumferential speed of 100 m per min., cutting depth of 1.0 mm and feed rate of 0.07 mm per revolution. The foregoing shapes of chips were classified as shown in FIGS. 2A, 2B and 2C. FIG. 2A shows cuttings of quality A, FIG. 2B shows cuttings of quality B, and FIG. 2C shows cuttings of quality C.

Figure 3A:
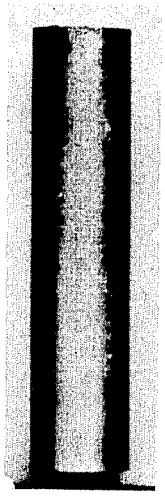
FIGS. 3A and 3B show classified representations of the state of corroded surfaces.
Figure 3B:
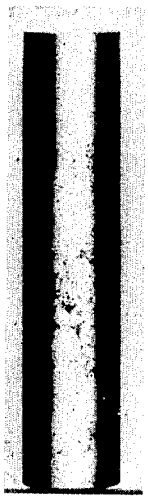

Corrosion tests were run under the following conditions: A rod of 10 mm in diameter was turned to a rod of 9 mm in diameter of which surface being finished to the grade of ~~w~~ (i.e., 1.6S to 6S). Then the materials were dipped for 24 hours in an accelerating corrosion medium consisting of 100 cc of 3.5% solution of salt (NaCl) and 3 cc of 30% solution of hydrogen peroxide. Etched surfaces are classified into two grades as shown in FIGS. 3A and 3B, for comparison of corrosion resistance. FIG. 3A shows an etched rod of quality A+ and FIG. 3B shows an etched rod of quality A.

The summarized results of foregoing tests are presented in Table II, wherein alphabetical symbols signify:

A++: excellent A+: superior A: normal
B: no trouble in practical use
C: poor and conventional alloy Y is inferior in preventing abrasion of cutting tools. Furthermore, the comparative alloys reveal similar characteristics to the alloy Y when the content of Cr or V exceeds the specified maximum.

For a further set of tests carried out on the preventive property of peeling-off of the oxidized coating, the test specimens were manufactured in following processes. An ingot of 8 inches in diameter was heat treated at 500° C. for 12 hours for homogenizing, then extruded at a temperature of 420° C. to a rod of 20 mm in diameter, subsequently drawn at room temperature to a rod of 17 mm in diameter, followed by solution heat treatment at 520° C., and then artifical age-hardening at 175° C. for 8 hours to obtain T6 tempered material. After machining to a rod of 15 mm in diameter, anodic oxidation was carried out in a sulphuric bath of 15% concentration to form oxidized coating of 15 microns in thickness on the surface. Sealing operation or pinhole sealing was perfectly executed in a boiling bath of ion-exchange resin water. The finished test specimens were heated in the atmosphere and kept for 1 hour at a temperature which was step-by-step raised at a rate of 10° C. in each step from room temperature up to 280° C. The heating temperature and duration time of the last step are far more severely specified, compared with the customary baking and curing conditions of acrylic resin coating, which specify the temperature of 220° C. and the duration of between 10 and 20 minutes.

Table II

| | Symbol | Cast-ability | Hot Work-ability | Free Cutting Property | Corrosion Resistance | Surface Treatability | Resistance for Abrasion of Tool | Resistance for Stress Corrosion Cracking | Environmental Condition of Cutting Operation | Yield Strength Kg/mm² | Tensile Strength Kg/mm² | Elongation % |
|---|---|---|---|---|---|---|---|---|---|---|---|---|
| | | Test Results of The Alloys in Table I | | | | | | | | | | |
| Conventional Alloys | X | A+ | A+ | C | A | A | B | A | A | 28 | 32 | 18 |
| | Y | A | A | B | A | B | C | A | A | 27 | 31 | 16 |
| Alloys of the Invention | A1 | A+ | A+ | A | A+ | A+ | A | A | A | 27 | 32 | 18 |
| | A2 | A++ | A+ | A | A+ | A+ | A | A | A | 27 | 32 | 19 |
| | A3 | A+ | A+ | A | A+ | A+ | A | A | A | 28 | 33 | 17 |
| | A4 | A+ | A+ | A | A+ | A+ | A | A+ | A | 28 | 33 | 17 |
| | A5 | A+ | A+ | A | A+ | A+ | A | A+ | A | 28 | 33 | 16 |
| | A6 | A+ | A+ | A | A+ | A+ | A | A+ | A | 30 | 35 | 16 |
| | A7 | A+ | A+ | A | A+ | A+ | A | A+ | A | 31 | 35 | 16 |
| | A8 | A++ | A+ | A | A+ | A+ | A | A+ | A | 30 | 35 | 15 |
| | A9 | A++ | A+ | A | A+ | A+ | A | A+ | A | 30 | 35 | 15 |
| | K1 | A++ | A+ | A | A+ | A+ | A | A | C | 27 | 32 | 19 |
| Comparative Alloys | K2 | A | A | B | A+ | A+ | C | A+ | A | 26 | 31 | 17 |
| | K3 | A | A | A | A+ | A | C | A+ | A | 28 | 32 | 17 |
| | K4 | A | A | A | A+ | A | C | A+ | A | 29 | 33 | 15 |
| | K5 | A | A | A | A+ | A | C | A+ | A | 31 | 35 | 16 |

These test results clearly show that the alloys of the present invention have well-balanced and excellent properties of many kinds. On the other hand, the conventional alloy X is rather poor in free-cutting property Two kinds of peeling-off tests on the anodically oxidized coating were carried out as follows.

Test 1 was run with the alloys of the present invention, comparative alloys and conventional alloys of which chemical components are set forth in Table III.

Table III

| | Symbol | Mg | Si | Cu | Sn | Pb | Sn + Pb | Bi | Cr | Mn | Ti | V | Zr | Procedure A | Procedure B | Procedure C |
|---|---|---|---|---|---|---|---|---|---|---|---|---|---|---|---|---|
| | | Chemical Compositions of Alloys in Test 1 and Test Results: Chemical Compositions (weight percents) | | | | | | | | | | | | Critical Temperature | | |
| Conventional Alloy | Z | 1.0 | 0.6 | | 0.4 | 0.6 | [c4]0.2 | 0.4 | 0.1 | 0.8 | 0.1 | | | 200° C | 150° C | 140° C |
| | B1 | 0.85 | 0.7 | 0.3 | 1.1 | 0.6 | 1.7 | | 0.2 | | | | | 280 | 250 | 250 |
| Alloys of the Invention | B2 | " | " | " | " | " | " | | | 0.4 | | | | 280 | 240 | 240 |
| | B3 | " | " | " | " | " | " | | | | 0.15 | | | 280 | 230 | 230 |
| | B4 | " | " | " | " | " | " | | | | | 0.15 | | 280 | 240 | 240 |
| | B5 | " | " | " | " | " | " | | | | | | 0.2 | 280 | 240 | 240 |
| | B6 | " | " | " | " | " | " | | 0.2 | 0.1 | | | | 280 | 260 | 260 |
| | B7 | " | " | " | " | " | " | | 0.2 | | 0.1 | | | 280 | 260 | 260 |

Table III-continued

| | Symbol | Chemical Compositions of Alloys in Test 1 and Test Results — Chemical Compositions (weight percents) | | | | | | | | | | | | Critical Temperature | | |
|---|---|---|---|---|---|---|---|---|---|---|---|---|---|---|---|---|
| | | Mg | Si | Cu | Sn | Pb | Sn + Pb | Bi | Cr | Mn | Ti | V | Zr | Procedure A | Procedure B | Procedure C |
| | B8 | " | " | " | " | " | " | | 0.2 | | | 0.1 | | 280 | 260 | 260 |
| | B9 | " | " | " | " | " | " | | 0.2 | 0.2 | | | 0.1 | 280 | 270 | 270 |
| | B10 | " | " | " | " | " | " | | 0.2 | 0.1 | 0.05 | | | 280 | 260 | 260 |
| Comparative Alloy | L1 | 0.85 | 0.7 | 0.3 | 1.1 | 0.6 | 1.7 | | | | | | | 280 | 160 | 160 |

For testing conditions, three procedures were carried out with each of the foregoing test materials manufactured from alloys as specified below:

Procedure A

Each test material, heated under the aforesaid conditions, was observed at the surface whether the oxidized coating was peeled-off or not. The "Critical Temperature" for Procedure A in Table III designates the lowest temperature at which any failure or any partial peeling-off (including any blister) began to appear. The Critical Temperatures obtained in Procedure A for the alloys of the present invention and for the comparative alloys were both 280° C. which are about 80° C. higher than that of the conventional alloys which indicated 200° C.

Procedure B

Immediately after heating, five parallel lines rectangularly crossed with other five parallel lines, in a lattice manner at an interval of 2 mm were scratched with a razor blade on the cured surface deep enough to reach the matrix. A strip of adhesive tape was applied over the lattice on each test specimen then the tape was peeled off instantly. The critical temperature for Procedure B in Table III is the highest temperature at which the oxidized coating did not adhere to the tape, i.e., was not peeled off. The Critical Temperatures shown by Procedure B were between 230° C. and 270° C. for the alloys of the present invention, while, for the comparative alloy, it was only 160° C. and for the conventional alloy only 150° C., certifying that the alloys of the present invention show an unexpectedly excellent preventive property against peeling-off of the oxidized coating.

Procedure C

The test was run in the same manner as Procedure B after being exposed to the atmosphere for 50 days after heating. In Procedure C, including changes which occurred over the 50 day period, neither Critical Temperatures of the alloys of the present invention nor that of the comparative alloy were lowered, selectively compared with those which were obtained in Procedure B, while that of the conventional alloy was lowered 10° C. Therefore, the alloys of the present invention secure the preventive property from peeling-off of the oxidized coating for a long period without any further changes after heating at a temperature far above that necessary for curing of paint.

Test 2 was run with the alloys of the present invention and the comparative alloys, the chemical compositions of which are set forth in Table IV. A piece of an adhesive tape was stuck to each coated surface of test specimens after being treated as above described, and was peeled off instantly therefrom, thus, the stability of the coating was observed and checked. The "good" indication in the table designates a state of being free from any peeling-off, and "no good" indicates a state with any slight or partial peeling-off. The test results show that the anodically oxidized coating on the product surfaces of the alloys of the present invention remain without any peeling-off at conditions of an elevated temperature up to 260° C. or 270° C., while the coating on the comparative alloys will be peeled off at a temperature higher than 180° C.

Table IV

| | Symbol | Chemical Compositions of Alloys in Test 2 and Test Results — Chemical Compositions (weight percents) | | | | | | | | | | | Heating temperature | | | |
|---|---|---|---|---|---|---|---|---|---|---|---|---|---|---|---|---|
| | | Mg | Si | Sn | Pb | Cu | Cr | Mn | Ti | Zr | V | Be | 150° C | 180° C | 260° C | 270° C |
| Alloys of the Invention | C1 | 0.6 | 0.5 | 0.8 | 0.4 | 0.2 | 0.07 | 0.3 | 0.1 | | | | good | good | good | good |
| | C2 | " | " | " | " | " | " | | 0.1 | 0.2 | | | " | " | " | " |
| | C3 | " | " | " | " | " | " | 0.3 | | | | | " | " | " | " |
| | C4 | " | " | " | " | " | " | | | 0.17 | | | " | " | " | " |
| | C5 | 0.8 | 0.7 | 1.1 | 0.6 | 0.3 | 0.2 | | | | | | " | " | " | no good |
| | C6 | " | " | " | " | " | " | 0.25 | | | | 0.02 | " | " | " | good |
| | C7 | " | " | " | " | " | " | | 0.15 | 0.12 | | | " | " | " | " |
| | C8 | " | " | " | " | " | " | 0.2 | | 0.10 | | | " | " | " | " |
| | C9 | 1.0 | 0.75 | 1.4 | 0.6 | 0.3 | 0.15 | | 0.15 | | | | " | " | " | " |
| | C10 | " | " | " | " | " | " | | | | 0.10 | | " | " | " | " |
| | C11 | " | " | " | " | " | " | 0.15 | | | | 0.02 | " | " | " | " |
| | C12 | " | " | " | " | " | " | | | | 0.17 | 0.01 | " | " | " | " |
| | C13 | 0.85 | 0.7 | 1.4 | 0.6 | 0.3 | 0.3 | | | | | | " | " | " | no good |
| | C14 | " | " | " | " | " | " | 0.15 | | 0.12 | 0.10 | | " | " | " | good |
| | C15 | " | " | " | " | " | " | | | 0.20 | | 0.01 | " | " | " | " |
| | C16 | " | " | " | " | " | " | 0.25 | | 0.10 | | | " | " | " | " |
| Comparative Alloys | M1 | 0.85 | 0.7 | 1.4 | 0.6 | 0.2 | | | | | | | good | no good | no good | no good |
| | M2 | " | " | " | " | " | | 0.25 | | 0.12 | | | " | " | " | " |
| | M3 | " | " | " | " | " | | | | | 0.25 | 0.01 | " | " | " | " |
| | M4 | " | " | " | " | " | | | | 0.17 | | | " | " | " | " |

Summarizing the results of Tests 1 and 2, the property of preventing peeling-off of the oxidized surface may be concluded to be obtained as follows. Addition of traces of any element of Cr, Mn, Ti, V and Zr exceedingly improves the preventive property for the peeling-off of the oxidized coating, and particularly, addition of more than two elements including Cr raises the critical temperature. Although conventional alloys containing Cr, Mn or Ti are known, the added amount and the combination ratio of metals of low melting point nature which are to be added to an aluminum alloy to improve the free-cutting properties, are fundamentally different from those of the alloys of the present invention. Therefore, known combinations of these metallic elements have not contributed to improve the preventive property from peeling-off of the oxidized coating and particularly, as seen from the data of Procedure C in Test 1, it should be noted that the Critical Temperature can be improved by more than 100° C. by the present invention. The Critical Temperatures of from 240° C. to 270° C. and one hour duration for the alloys of the present invention are much safer for a conventional curing condition of acrylic resin paint which requires the temperature of 220° C. and a duration time of between 10 and 20 minutes.

As described above, addition of small amounts of foregoing elements according to the present invention has made it possible to prevent the formation of any oxidized film or layer of micron order in thickness between the matrix of the alloy and the anodic oxidation coating, and that enables the alloy of the present invention to be free from peeling-off of the oxidized surface layer after the product being heated at a temperature higher than 160° C. for curing of coated paint.

It will be obvious to those skilled in the art that various changes may be made without departing from the scope of the invention and the invention is not to be considered limited to what is shown in the drawing and described in the specification.

What is claimed:

1. An aluminum base alloy of free machinability and of corrosion resistance, consisting essentially of: from 0.6 to 1.2 weight percent magnesium, from 1.2 to 2.4 weight percent of the sum of tin and lead, wherein the weight quantity of tin exceeds that of lead; from 0.5 to 0.8 weight percent silicon; from 0.1 to 0.4 weight percent copper; and the balance essentially aluminum and inevitable impurities.

2. An aluminum base alloy according to claim 1 further containing chromium in an amount from 0.05 to 0.3 weight percent.

3. An aluminum base alloy according to claim 1 consisting essentially of: from 0.6 to 1.2 weight percent magnesium; from 0.8 to 1.6 weight percent tin; from 0.4 to 0.8 weight percent lead; from 0.5 to 0.8 weight percent silicon; from 0.1 to 0.4 weight percent copper; and the balance essentially aluminum and inevitable impurities.

4. An aluminum base alloy according to claim 1 further containing optionally any one or more than one element of: from 0.1 to 0.5 weight percent manganese; from 0.02 to 0.2 weight percent titanium; from 0.05 to 0.3 weight percent vanadium; and from 0.05 to 0.3 weight percent zirconium.

5. An aluminum base alloy according to claim 1 containing beryllium in an amount up to 0.03 weight percent.

6. An aluminum base alloy according to claim 2 containing optionally any one or more than one element of: from 0.1 to 0.5 weight percent manganese; from 0.2 to 0.2 weight percent titanium; from 0.05 to 0.3 weight percent vanadium; and from 0.5 to 0.3 weight percent zirconium.

7. A product made of an aluminum base alloy according to claim 2 with a portion thereof being anodically oxidized, coated with resinous paint thereon and cured at an elevated temperature higher than 160° C.

8. A product made of an aluminum base alloy according to claim 6, with a portion thereof being anodically oxidized, coated with resinous paint thereon and cured at an elevated temperature higher than 160° C.

* * * * *